United States Patent [19]

Francois et al.

[11] Patent Number: 4,985,003

[45] Date of Patent: Jan. 15, 1991

[54] BRANCHING ELECTRICAL CONNECTOR AND SPACER THEREFOR

[75] Inventors: Pierre Francois, Limoges; Michel H. M. F. Prodel, Troche, both of France

[73] Assignee: S.I.C.A.M.E. Societe Industrielle de Construction d'Appareils et de Material Electrique, Arnac Pompadour, France

[21] Appl. No.: 351,378

[22] Filed: May 9, 1989

[30] Foreign Application Priority Data

May 13, 1988 [FR] France ..... 88 06465

[51] Int. Cl.[5] ..... H01R 4/40; H01R 4/44

[52] U.S. Cl. ..... 439/781; 439/475; 439/789; 439/810

[58] Field of Search ..... 430/781, 782, 786, 789, 430/790, 810, 811

[56] References Cited

U.S. PATENT DOCUMENTS

| | | | |
|---|---|---|---|
| 2,963,679 | 12/1960 | Jugle | 339/246 |
| 3,177,459 | 4/1965 | Toedtman | 439/781 |
| 3,629,805 | 12/1971 | Peek | 439/475 |
| 4,097,108 | 6/1978 | Prodel | 439/475 |
| 4,643,512 | 2/1987 | Prodel | 339/248 R |
| 4,684,196 | 8/1987 | Smith et al. | 439/781 |
| 4,707,051 | 11/1987 | Hall | 439/781 |

FOREIGN PATENT DOCUMENTS

| | | | |
|---|---|---|---|
| 0078023 | 9/1949 | Czechoslovakia | 439/781 |
| 2053754 | 8/1971 | Fed. Rep. of Germany . | |
| 2155349 | 5/1973 | France . | |
| 2566191 | 12/1985 | France . | |
| 2601516 | 1/1988 | France . | |
| 1171780 | 11/1969 | United Kingdom . | |

*Primary Examiner*—Paul A. Bradley

*Attorney, Agent, or Firm*—Charles E. Brown; Charles A. Brown

[57] ABSTRACT

A spacer for use in a branching electrical connector comprises two jaws and clamping device for clamping the jaws together. At least two parallel channels are defined by the jaws, the spacer being adapted to hold one of the channels temporarily at least partly open. Overridable abutment on the spacer yield when sufficient force is applied to the jaws by the clamping device to enable the temporarily open channel to be closed.

34 Claims, 3 Drawing Sheets

FIG. 1
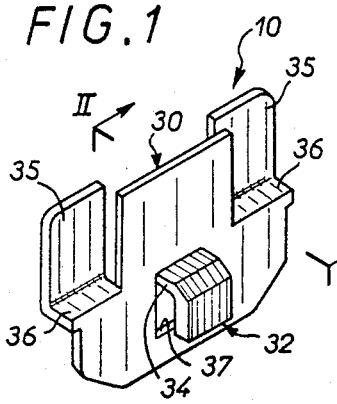
FIG 2
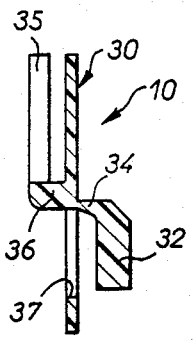
FIG. 6
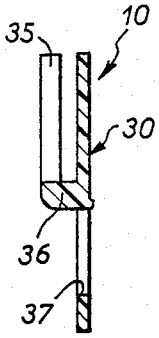
FIG. 7
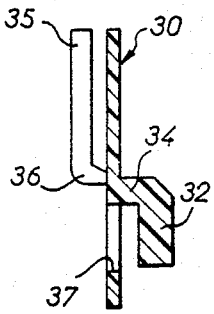
FIG. 8
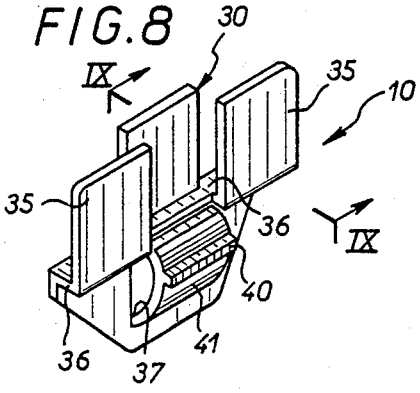
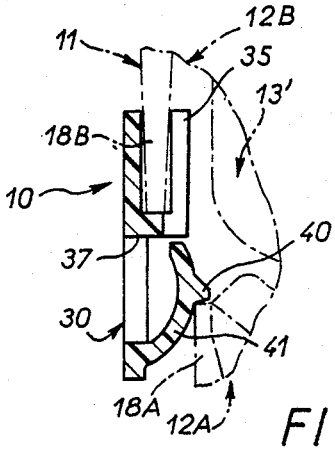
FIG. 9
FIG. 3
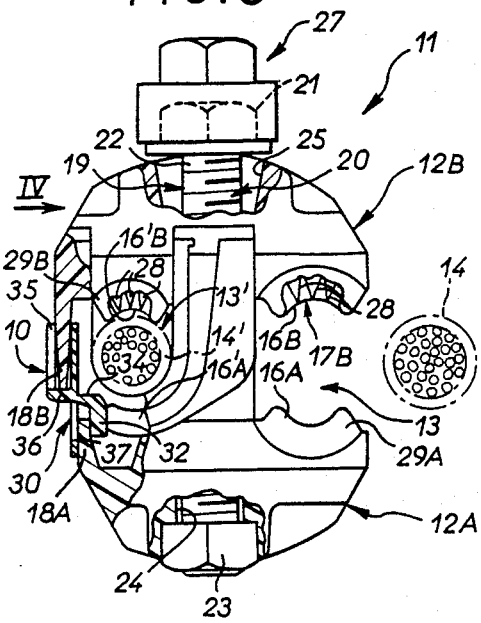
FIG. 4
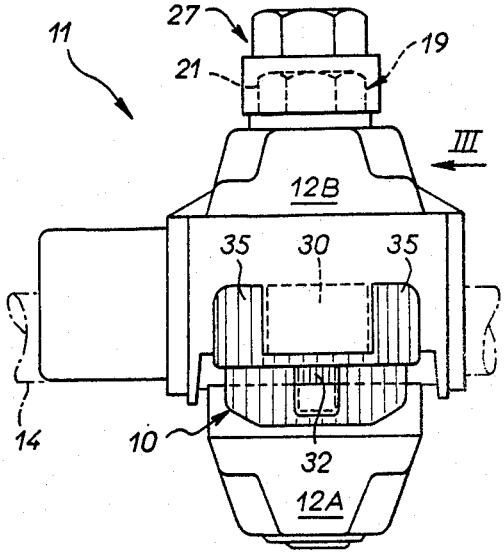

FIG.10
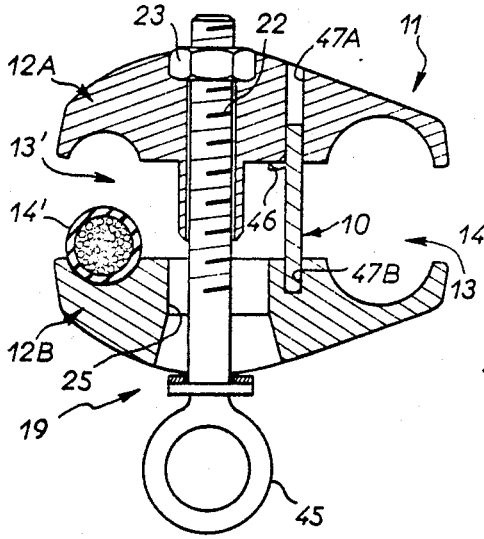
FIG.11
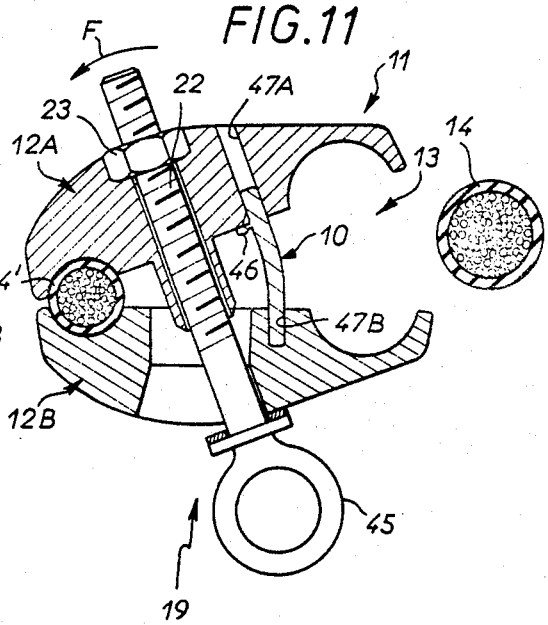
FIG.12
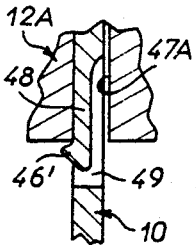
FIG.13
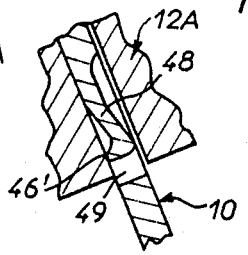
FIG.15
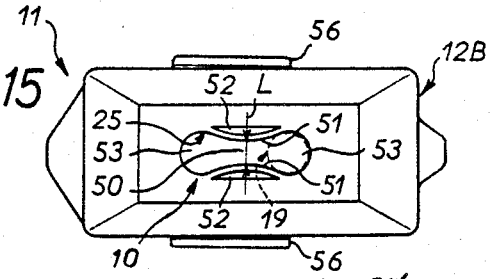
FIG.16
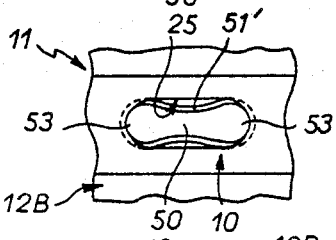
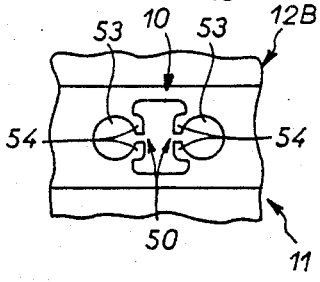
FIG.17
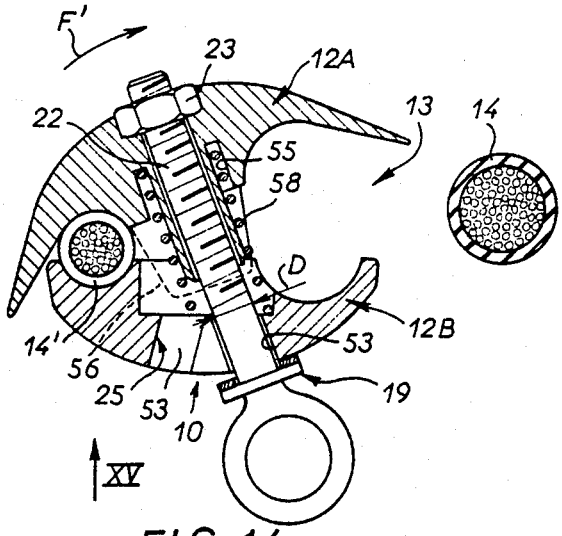
FIG.14

BRANCHING ELECTRICAL CONNECTOR AND SPACER THEREFOR

BACKGROUND OF THE INVENTION

1. Field of the Invention

The present invention concerns branching electrical connectors having two jaws, clamping means for clamping the jaws together and at least two parallel channels defined by the jaws, one for a first or main cable from which the branch connection is to be made and the other for a second or branch cable to be connected to the first cable.

The invention is more particularly, but not exclusively, directed to branching electrical connectors of this kind in which the clamping means normally close both channels simultaneously without distinguishing between them, at least one of the jaws incorporating at least one contact member adapted to engage with both the channels and therefore with both the cables disposed therein, establishing an electrical bridge between them.

2. Description of the Prior Art

These branching connectors are generally called parallel jaw branching connectors or non-separate branch cable branching connectors.

Branching connectors of this type are described in French patent No. 2 155 349 and French patent No. 2 601 516 to French patent No. 2 566 191.

In practise, because each of the jaws of a branching connector of this kind functions simultaneously in both the parallel channels that the jaws define between them, at least one jaw has to be capable of tilting movement relative to the other when they are clamped up to cater for the situation (which happens to be the most usual situation encountered in practise) where the cables to be clamped are of different diameters.

To achieve this the clamping means for the jaws usually comprise at least one fastening rod which passes through one of them by means of an enlarged passage in which it can "tilt" as the assembly is clamped up.

The same applies if the clamping means comprise two parallel fastening rods.

When the jaws are clamped up they first engage the larger diameter cable, usually the main cable, and then after relative tilting between them they engage the smaller diameter cable, usually the branch cable.

This arrangement has the advantage of relatively economical implementation but the disadvantage that the branching connectors are relatively inconvenient or even difficult to fit to the electrical cables to be joined.

When the jaws of a branching connector of this kind are sufficiently open (as is necessary for insertion of the cables to be connected into the channels that they delimit, especially when, as is usually the case for the main cable, this fitting has to be done to a "passing" cable, by which is meant a continuous line cable or conductor) they are totally unrestricted in terms of movement relative to each other and they therefore tend to close upon each other in a disorderly way, as a result of their own weight if for no other reason, and they then approach each other either correctly or, what is worse, skewed relative to each other, which usually happens if the clamping means comprise only one assembly rod.

As a result the fitter who has to make a branch connection from a main cable must, when the jaws of the branching connector to be used for this purpose have been opened sufficiently, be able to close temporarily the branching connector by hand onto the main cable and simultaneously introduce into the connector the branch cable to be connected to the main cable, then to hold the resulting assembly together by hand, and finally to clamp up the jaws of the branching connector; given that the main cable is generally a line cable, the fitter is often in an uncomfortable position, (for example at the top of a ladder or post, so that he can reach the line cable directly), and what is more is usually wearing the regulation gloves, which render his gestures less accurate.

It is obvious that in such circumstances the operations to be performed are difficult to carry out.

The same applies when the branching connector is fitted to the main cable remotely (e.g. from the ground), using a pole, which is another situation that may well arise.

A general objective of the present invention is to provide an arrangement to facilitate these operations.

SUMMARY OF THE INVENTION

In one aspect, the invention consists a spacer for use in a branching electrical connector comprising two jaws, clamping means for clamping the jaws together and at least two parallel channels defined by the jaws, the spacer being adapted to hold one of the channels at least partly open temporarily and comprising overridable abutment means adapted to yield when sufficient force is applied to the jaws by the clamping means to enable the one channel to be closed.

The spacer in accordance with the invention may be embodied in various ways, both for branching connectors to be fitted directly and for those to be fitted remotely, and the spacer may be a part independent of the branching connector with which it is associated or an integral part thereof.

Be this as it may, the spacer has the advantage that clamping can be done in two stages.

In a first stage the spacer holds open one of the channels in the branching connector, either the channel designed to receive the branch cable if the branching connector is to be fitted directly to a main cable or the channel designed to receive the main cable if the branching connector is to be fitted to the main cable remotely, using a pole.

On clamping up the connector, only the other channel is initially closed.

The jaws of the connector are progressively closed onto the cable in this channel until contact with the cable occurs and closure continues until initial or provisional clamping of the branching connector onto the cable results.

The mechanical retention of the branching connector onto the cable concerned being then assured, it is no longer necessary for the fitter to hold it in position by hand. This facilitates the further operations required, in particular the fitting into the other channel of the branching connector (held open by the spacer in accordance with the invention) of the branch cable in the case of a branching connector to be fitted directly to a main cable or the fitting of the open channel of the branching connector onto the main cable in the case of a branching connector to be fitted remotely to a main cable using a pole.

The clamping up of the jaws is completed in a second stage.

The overridable abutment means that the spacer in accordance with the invention comprises then yield and both channels of the branching connector are clamped up for final clamping of the connector onto the main cable and onto the branch cable.

A procedure of this kind has the advantage of facilitating all the operations to be carried out.

U.S. Pat. No. 2,963,679 teaches fitting a non-separated branching connector in two stages.

However, the means deployed to this end in this patent comprises springs fitted in advance to the connector concerned and removed therefrom after final clamping up.

The removal of these springs requires an operation completely separate to that needed to clamp up the connector.

This does not apply to the spacer in accordance with the invention.

To the contrary, this spacer comprises overridable abutment means which are adapted to provide a temporary but positive abutment and which are adapted to yield beyond a particular threshold when the connector is clamped up, no separate operation being required to override these abutment means, the clamping up of the connector being sufficient to procure this.

This results in an advantageous simplification in the fitting of a connector of this kind.

In another aspect, the present invention consists in a branching electrical connector comprising two jaws, clamping means for clamping the jaws together, at least two parallel channels defined by the jaws, a spacer adapted to hold one of said channels at least partly open temporarily and overridable abutment means on the spacer adapted to yield when sufficient force is applied to the jaws by the clamping means to enable the one channel to be closed.

The objects, characteristics and advantages of the invention will emerge from the following description given by way of example only and with reference to the appended diagrammatic drawings.

BRIEF DESCRIPTION OF THE DRAWINGS

FIG. 1 is a perspective view of a spacer in accordance with the invention

FIG. 2 is a view of it in transverse cross-section on the line II—II in FIG. 1.

FIG. 3 is a locally cut away side view in the direction of the arrow III in FIG. 4 of a branching electrical connector fitted with a spacer of this kind.

FIG. 4 is an elevational view in the direction of the arrow IV in FIG. 3 of this branching electrical connector.

FIG. 6 is a view in transverse cross-section analogous to that of FIG. 2 and showing the spacer in accordance with the invention after this functioning.

FIG. 7 is a view in transverse cross-section also analogous to that of FIG. 2 and relating to an alternative embodiment of the spacer in accordance to the invention.

FIG. 8 is a perspective view analogous to that of FIG. 1 and relating to a further embodiment of the spacer in accordance with the invention.

FIG. 9 is a view of this spacer in transverse cross-section on the line IX—IX in FIG. 8.

FIG. 10 is a view in transverse cross-section of another branching electrical connector with which is associated another spacer in accordance with the invention.

FIG. 11 is a view in transverse cross-section analogous to that of FIG. 10 and showing the functioning of the spacer in accordance with the invention in this branching electrical connector.

FIG. 12 shows to a larger scale a detail of FIG. 10 for an alternative embodiment.

FIG. 13 is a view analogous to that of FIG. 12 showing the functioning of this embodiment.

FIG. 14 is a view in transverse cross-section analogous to that of FIG. 11 for a further embodiment of the spacer in accordance with the invention.

FIG. 15 is a partial view from below as seen in the direction of the arrow in FIG. 14 of the branching electrical connector concerned with the fastening rod removed.

FIGS. 16 and 17 are partial views from below analogous to that of FIG. 15 each relating to a respective alternative embodiment of the spacer fitted in accordance with the invention to the branching electrical connector concerned.

DESCRIPTION OF THE PREFERRED EMBODIMENTS

Figure 5A:
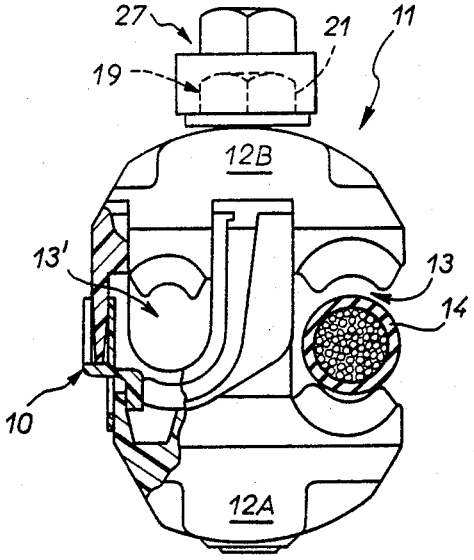
FIGS. 5A through 5D are side views analogous to that of FIG. 3 showing different phases in the functioning of the spacer in accordance with the invention.

As shown in the figures, the spacer 10 in accordance with the invention is generally designed to be fitted to a branching electrical connector 11 featuring two jaws 12A, 12B which are moved towards each other by clamping means to be described later and which are adapted to define between them at least two parallel channels 13, 13', one for a first or main cable 14 and the other for a second or branch cable 14' to be connected electrically to the first cable.

As shown in FIGS. 3 through 5, for example, the branching electrical connector 11 is of the type which is the subject matter of the previously mentioned French patent No. 2 601 516.

As a branching electrical connector of this general kind is well known in itself and does not of itself form any part of the present invention it will not be described in complete detail here.

Only those of its component parts necessary to an understanding of the invention will be described.

To define the channels 13, 13' the jaws 12A, 12B form respective parallel cradles 16A, 16'A, 16B, 16'B. For the electrical connection to be made between the cables 14, 14' at least one of the jaws 12A, 12B (in practise both of them) carries at least one (in practise two parallel) metal contact members 17A, 17B transversely disposed relative to the channels 13, 13'. On the side of the channel 13 the jaws 12A, 12B feature respective flange 18A, 18B parallel to each other and to the channels 13, 13'. The clamping means associated with the jaws 12A, 12B comprise a single fastening rod 19 formed by a bolt 20 with a head 21 and threaded shank 22 and a nut 23. It is disposed between the channels 13, 13', perpendicular to the plane of their axes. It is engaged with the jaw 12A by the nut 23 accommodated in a well 24 in the jaw 12A and extends from the nut 23 and through the jaw 12B by means of an enlarged passage 25 therein in which it is able, when the jaws 12A, 12B are clamped up, to "tilt" transversely relative to the axes of the channels 13, 13'. The head 21 of the bolt 20 is outside the jaw 12B so as to be accessible to the fitter.

The passage 25 in the jaw 12B is in fact a slot perpendicular to the axes of the channels, 13, 13', initially cylindrical and then diverging frustoconically to its outlet.

For reasons which are not relevant to the present invention, the head 21 of the bolt 20 of the fastening rod 19 is capped by an end-part 27 adapted to break off at a predetermined torque.

Because this application is concerned with insulated cables 14, 14' the contact members 17A, 17B of the jaws 12A, 12B are of the insulation piercing type and each features teeth 28 in line with the corresponding cradles 16A, 16'A, 16B, 16'B. Each contact member 17A, 17B is surfaced with an elastically deformable material 29A, 29B from which the teeth 28 project locally.

This is an optional arrangement, however, which must not be regarded as limiting the invention in any way.

The embodiment of the spacer 10 in accordance with the invention shown in FIGS. 1 through 6 forms a part independent of the branching electrical connector 11 with which it is associated and is designed to hold one of the channels 13, 13' of the branching electrical connector 11 at least partially open, temporarily, when the jaws 12A, 12B are clamped up. To this end it comprises overridable abutment means adapted to yield when a sufficient load is applied to the jaws 12A, 12B by the clamping means constituted by the fastening rod 19.

In the embodiment shown in FIGS. 1 through 6 the spacer 10 comprises a plate 30 adapted to lie against the flange 18A, 18B of either jaw 12A, 12B, on a first side thereof.

In practise the plate 30 is adapted to lie against both the flanges 18A, 18B of the jaws 12A, 12B, on the outside of the flange 18A of the jaw 12A and on the inside of the flange 18B of the jaw 12B, as shown in FIG. 3.

The spacer 10 in accordance with the invention further comprises at least one lug 32 substantially parallel to the plate 30 merging with the plate 30 through a right-angle bend 34. By this means it is adapted to flank either of the flanges 18A, 18B of the jaws 12A, 12B on the side thereof opposite that against which the plate 30 lies, so "straddling" the flange 18A, 18B concerned.

In the embodiment shown the assembly rod 19 is locked to the flange 18A of the jaw 12A and it is therefore the flange 18A which is straddled by the lug 32.

To enable it also to straddle the flange 18B of the jaw 12B the spacer 10 in accordance with the invention further comprises at least one lug 35 with a right-angle bend 36.

In this embodiment the spacer 10 in accordance with the invention therefor comprises on a first side of the plate 30 at least one lug (the lug 32) which extends in a first direction and through which it is adapted to cooperate with a first jaw (the jaw 12A) and on the other side of the plate 30 at least one lug 35 which extends in the opposite direction and through which it is adapted to cooperate with the second jaw (the jaw 12B).

In practise two lugs 35 are provided for the jaw 12B, parallel to each other and to the lug 32. The lug 32 is in the central part of the plate 30, adjacent an aperture 37 in the plate adapted to facilitate its manufacture by molding, whereas the two lugs 35 lie each on a respective side of the central area, along the edges of the plate 30.

The right-angle bend 34 of the lug 32 and those 36 of the lugs 35 are substantially in alignment along a median line of the plate 30 perpendicular to the length of the lugs 32, 35.

In this embodiment the overridable abutment means that the spacer 10 comprises in accordance with the invention are readily breakable abutment means and form part of the lug 32 of the spacer 10, namely the right-angle bend 34 thereof.

To render it readily breakable the right-angle bend 34 incorporates an area of reduced thickness.

To this end its thickness decreases in the direction towards the plate 30, as shown in FIG. 2.

On the other hand, the thickness of the right-angle bends 36 of the lugs 35 is significantly greater than that of the right-angle bend 34 of the lug 32 and is substantially constant.

The procedure for fitting a branching electrical connector 11 to a continuous main cable 14 (in practise a line cable) is as follows.

First of all, and while the fitter is still on the ground, for example, the jaws 12A, 12B are moved sufficiently far apart by unscrewing the assembly rod 19 for the plate 30 and lugs 35 of the spacer 10 in accordance with the invention to be pushed fully home, straddling the flange 18B of the jaw 12B, so that the flange 18B is gripped between the plate 30 and the lug 35.

The assembly rod 19 is then screwed in until the flange 18A of the jaw 12A engages the spacer 10, between the plate 30 and the lug 32.

As shown in FIG. 3, this engagement is limited so that the channels 13, 13' remain wide open.

Engaged with both the jaws 12A, 12B, the spacer 10 in accordance with the invention advantageously both holds the jaws relative to each other and also guides them relative to each other.

There is then no particular problem for the fitter to fit over the main cable 14 the channel 13 of the branching electrical connector 11 fitted in this way with a spacer 10, as shown in FIG. 5A.

Using the fastening rod 19, the fitter then lightly clamps the jaws 12A, 12B onto the main cable 14.

This results in slight penetration into the main cable 14 of the corresponding teeth 28 of the contact members 17A, 17B, sufficient to hold the branching electrical connector 11 on the main cable 14 of its own accord.

The fitter then no longer needs to hold it in place by hand.

Figure 5B:
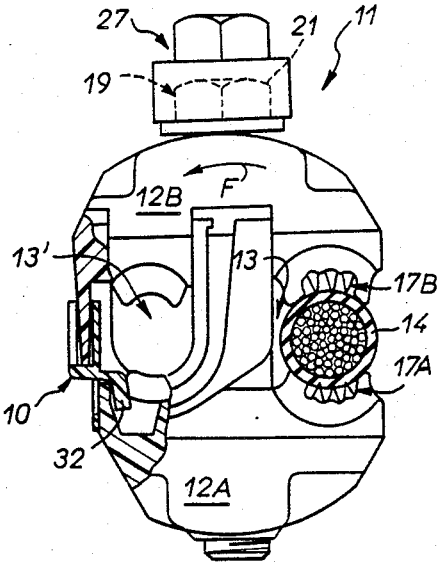

Because the fastening rod 19 is offset relative to the main cable 14 in the channel 13 on which the jaws 12A, 12B are now pressing, another result of the slight clamping is slight tilting of the jaw 12B relative to the jaw 12A, as shown by the arrow F in FIG. 5B, and therefore slight tilting of the jaw 12B towards the channel 13'.

Figure 5C:
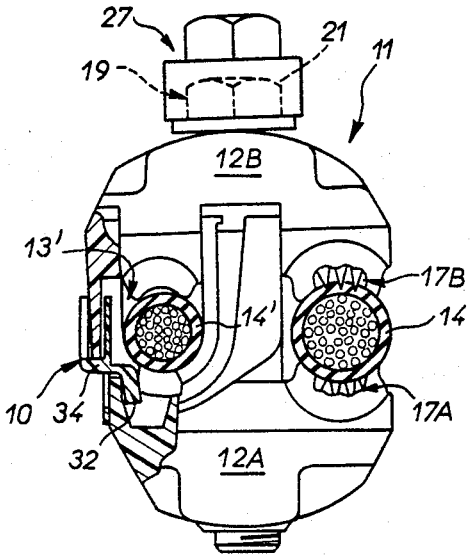

Although this tilting is accompanied by deeper penetration of the flange 18A of the jaw 12A between the plates 30 and the lug 32 of the spacer 10, accompanied by loading of the lug 32 in bending, the spacer 10 (which is designed specifically for this purpose) temporarily holds the channel 13 sufficiently open for the fitter to have no particular difficulty in inserting into it the branch cable 14' to be connected to the main cable 14, as shown in FIG. 5C.

Figure 5D:
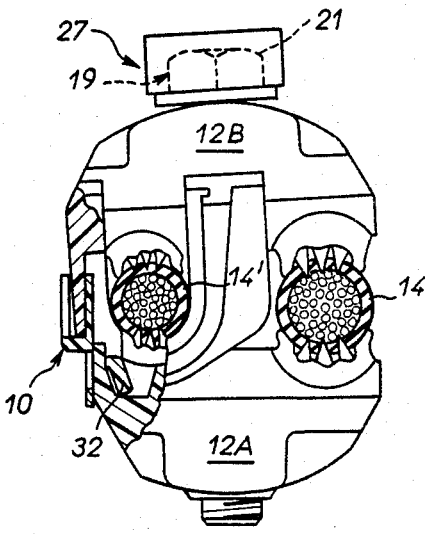

The fitter then has only to screw the fastening rod 19 in further for the right-angle bend 34 of the lug 32 on the spacer 10 to yield, as shown in FIGS. 5D and 6, whereupon the jaws 12A, 12B are also clamped onto the branch cable 14', while being more strongly clamped onto the main cable, until (as usual) the end-part 27 breaks away when the jaws 12A, 12B are clamped sufficiently tightly to the main cable 14 and to the branch cable 14'.

In the foregoing process the spacer 10 remains trapped in the branching electrical connector 11, and the same may be true of the lug 32 which becomes detached from it, its right-angle bend 34 having constituted the readily breakable and therefore overridable abutment means for the jaw 12B.

Indeed, it is within the branching electrical connector 11 that the lug 32 functions.

In the embodiment shown in FIG. 7 the lugs 35 on the spacer 10 constitute readily breakable and therefore overridable abutment means for the jaw 12B, their right-angle bends 36 being made thinner for this purpose, with the thickness decreasing towards the plate 30.

As these lugs 35 function outside the branching electrical connector 11, they drop to the ground when they are detached from the spacer 10.

Because of this they constitute indication means in that it is possible to determine from the ground that they have been broken off and therefore that the branching electrical connector 11 has been fitted correctly, which is preferable from the safety point of view.

To accentuate this signaling function at least one of the lugs 35 that the spacer 10 in accordance with the invention features (preferably both of them) may advantageously have a contrasted color marking.

The lugs 35 could be provided with a colored adhesive coating, for example.

In the embodiment shown in FIGS. 8 and 9 the overridable abutment means that the spacer 10 in accordance with the invention comprises are elastically retractable.

As previously, the spacer 10 comprises a plate 30 through which it is adapted to lie against the flange 18A, 18B of either of the jaws 12A, 12B, in practise the flange 18B of the jaw 12B, on one side of the flange 18B, and at least one lug 35 attached to the plate 30 by a right-angle bend 36 and disposed substantially parallel to the plate 30, through which it is adapted to flank the flange 18B on its other side, so that it straddles the flange 18B.

Also as previously, two lugs 35 are provided in this way along respective sides of the plate 30.

Unlike the previous arrangement, however, and as schematically represented in chain-dotted outline in FIG. 9, the lugs 35 function on the interior side of the flange 18B of the jaw 12B and the plate 30 functions on the exterior side of the flange 18B.

The elastically retractable abutment means that the spacer 10 comprises are constituted by at least one rib 40 projecting from an elastically deformable lug 41 which is one piece with the plate 30 in line with an aperture 37 therein and adapted to be placed on the path of the other jaw of the branching electrical connector 11 concerned and thus, as schematically represented in chain-dotted outline in FIG. 9, on the path of the jaw 12A.

In practise it is the edge of the flange 18A of the jaw 12A that is designed to cooperate with the rib 40.

The elastically deformable lug 41 carrying the rib 40 has a rounded profile, extending cantilever fashion from the edge of the plate 30 opposite that through which it is adapted, through the intermediary of the lugs 35, to be engaged on the jaw 12B, and therefore extending in the opposite direction to the jaw 12A with which the rib 40 has to cooperate.

A branching electrical connector 11 fitted with a spacer 10 of this kind is fitted as follows: when the jaws 12A, 12B are clamped up the rib 40 initially opposes relative displacement of the jaws 12A, 12B on the side of the channel 13, until the elastically deformable lug 41 which carries it yields elastically.

The lugs 35 and 41 that the spacer 10 in accordance with the invention incorporates are all on the same side of the plate 30.

The embodiments shown in FIGS. 10 through 17 are more particularly directed to the case where, unlike the previous arrangements, the branching electrical connector 11 concerned has to be fitted remotely to the main cable 14, its fastening rod 19 having to this end at the base of a threaded shank 22 cooperating with a nut 23 engaged with the jaw 12A (assumed here to be the upper jaw) a ring 45 for operating it remotely, using a pole, for example.

As these arrangements are well known in themselves and do not of themselves form any part of the present invention they will not be described here.

Suffice to say that, as previously, the threaded shank 22 of the assembly rod 19 passes through the jaw 12B (assumed here to be the lower jaw) by means of an enlarged passage 25 in the jaw 12B in which it can tilt when the jaws 12A, 12B are clamped up.

In the embodiment shown in FIGS. 10 and 11 the spacer 10 used in accordance with the invention is engaged with both the jaws 12A, 12B at a distance from the assembly rod 19 and, being inherently flexible, the overridable abutment means that it comprises are constituted by a readily breakable transverse stub 46 in contact with one of the jaws 12A, 12B, in this instance the jaw 12A.

The spacer 10 is a simple plate one edge of which slides in a groove 47A in the jaw 12A and the opposite edge of which is inserted in a fixed way in a groove 47B in the jaw 12B.

This spacer 10 is fitted in advance to the branching electrical connector 11 with which it is associated, holding the jaws 12A, 12B of the latter apart (FIG. 10).

On the ground, the first step is to place the branch cable 14' into the channel 13' (FIG. 10) and then to lightly tighten the fastening rod 19.

Because of the support provided to one side of the fastening rod 19 by the stub 46 on the spacer 10, the jaw 12A tilts relative to the jaw 12B, towards the channel 13', as shown by the arrow F in FIG. 11. As a result the jaws 12A, 12B close onto the branch cable 14' to secure it adequately.

During this tilting movement the fastening rod 19, being attached to the jaw 12A, itself undergoes a tilting movement which, as shown in FIG. 11, moves it to one end of the enlarged passage 25 in the jaw 12B through which it passes.

The branching electrical connector 11, to which the branch cable 14' is now attached, can then be fitted in the conventional way onto the main cable 14 because, by virtue of the spacer 10, the channel 13 is still (but temporarily) wide open (FIG. 11), allowing it to be fitted onto the main cable 14.

As the fastening rod 19 is further tightened, the breakable stub 46 on the spacer 10 yields to enable joint clamping of the jaws 12A, 12B onto the main cable 14 and onto the branch cable 14'.

The fastening rod 19 then reverts to a substantially central position while, by sliding in the groove 47A in the jaw 12A, the spacer 10 takes up a position corresponding to the difference between the diameters of the main cable 14 and the branch cable 14'.

In the embodiment of FIGS. 12 and 13 the spacer 10 is as previously in the form of a simple plate, comprising by way of overridable abutment means an elastically retractable stub 46'.

In practise the stub 46' is carried by an elastically deformable tang 48 associated with a housing 49 in the spacer 10 adapted to receive at least part of the tang when it is deformed.

As shown here, for example, this housing 49 is formed by an aperture in the spacer 10 by which the elastically deformable tang 48 is delimited.

Be this as it may, when the clamping force applied to the jaws 12A, 12B is sufficient the elastically deformable tang 48 is accommodated in the housing 49 and, the stub 46 being therefore retracted, the jaw 12A is released.

In the embodiments shown in FIGS. 14 through 17 the tilting movement of the fastening rod 19 within the enlarged passage 25 in the jaw 12B is exploited to accommodate the spacer 10 in accordance with the invention within this widened passage 25.

To be more precise, the overridable abutment means that the spacer 10 comprises are placed on the path of movement of the fastening rod 19 within the passage 25.

As is seen more clearly in FIGS. 15 through 17, the overridable abutment means then form a throat 50 within the passage 25, the normal width L of the throat 50 being chosen to be less than the diameter D of the threaded shank 22 of the fastening rod 19.

To be more precise, in the embodiments shown in FIGS. 14 through 16 the spacer 10 in accordance with the invention comprises two elastically deformable blades 51 in face-to-face relationship constituting the overridable abutment means defining the throat 50. The blades 51 are elongate in the direction of the movement of the threaded shank 22 of the fastening rod 19 in the passage 25 in the jaw 12B and are curved towards each other.

The spacer 10 forms an integral part of the jaw 12B (FIG. 15), the blades 51 which constitute it arising directly from the corresponding walls of the passage 25, being delimited by an aperture 52 which separates them from the main part of these walls.

Alternatively (FIG. 16) the spacer 10 forms a part independent of the jaw 12B, in the form of an elongate ring, for example, generally in the shape of the digit 8, appropriately fitted in the passage 25 in the jaw 12B and appropriately retained therein.

Be this as it may, in either case the spacer 10 in accordance with the invention defines on either side of the throat 50 two lobes 53 each adapted to receive in a stable way the threaded shank 22 of the fastening rod 19.

For the preliminary position of partial clamping of the branch cable 14' (FIG. 14) the threaded shank 22 of the fastening rod 19 passes through one of the lugs 53, the channel 13 remaining wide open, as previously.

For subsequent clamping onto the main cable 14 the threaded to pass through the throat 50 formed by 10 in accordance with the invention, the throat 10 yielding elastically.

In the embodiment shown in FIG. 17, to form the throat 50 and therefore the overridable abutment means to which it corresponds the spacer 10 in accordance with the invention comprises, in face-to-face relationship, at least one pair of elastically deformable tangs 54, both disposed transversely to the path of the fastening rod 19, to be more precise the path of the threaded shank 22 thereof, in the passage 25 in the jaw 12B, extending towards each other.

The spacer 10 comprises two spaced pairs of elastically deformable tangs 54 to form two throats 50 in succession on said path.

The elastically deformable tangs 54 are in one piece with the corresponding walls of the passage 25 in the jaw 12B, so that the spacer 10 that they form constitutes an integral part of the latter and therefore of the branching electrical connector 11 concerned.

In FIG. 14, as mentioned above, the connector 11 concerned in shown in a preliminary, partial clamping or pre-clamping position on the branch cable 14'.

Previously to this pre-clamping phase the jaws 12A, 12B which constitute it are held open, in a position tilted relative to each other, by a spring 58 disposed in the conventional way around the fastening rod 19, in a housing 55 provided for this purpose on the jaw 12A, so providing free access to the channels 13, 13'.

During the pre-clamping phase the jaw 12A is moved towards the jaw 12B by the fastening rod 19 and against the action of the spring 58, remaining tilted relative to it. The threaded shank 22 of the fastening rod 19 slides freely in the lobe 53 of the spacer 10. The jaw 12A is prevented from turning relative to the jaw 12B in a disorderly manner by cheeks 56 which, in the known way, lie to either side of the jaw 12B.

As soon as the jaw 12A is in sufficient contact with the branch cable 14' placed in the channel 13' the connector 11 is stabilized on the branch cable 14' and the combination of the connector 11 and the branch cable 14' can then be fitted remotely to the main cable 14 in the conventional way, the corresponding channel 13 of the connector 11 having remained open.

Clamping up continuing by turning the fastening rod 19, the jaw 12A tilts relative to the jaw 12B towards the channel 13 as shown by the arrow F' in FIG. 14, given the offset of its contact with the branch cable 14' relative to the fastening rod 19. The latter is also subject to a tilting movement as a result of which its threaded shank 42 forces (at least partially, depending on the difference in diameter between the main cable 14 and the branch cable 14') the throat 50 of the spacer 10, so enabling simultaneous and effective clamping of the main cable 14 and the branch cable 14', the connector 11 then being in a "straightened" position (not shown) as compared with its position shown in FIG. 14.

Of course, the present invention is not limited to the embodiments described and shown, but encompasses any variant execution.

In particular, to enable two or more branch cables to be connected the branching electrical connector in accordance with the invention may comprise more than two channels.

We claim:

1. Spacer for use in a branching electrical connector comprising two jaws, clamping means for clamping the jaws together and at least two parallel channels defined by the jaws, the spacer being adapted to hold one of the channels at least partly open temporarily, and comprising overridable abutment means adapted to be disabled in response to sufficient force applied to the jaws by the clamping means to close the one channel.

2. Spacer according to claim 1, wherein the spacer defines means adapted to secure and guide the jaws relative to each other during an initial clamping up phase.

3. Spacer according to claim 1 which is independent of the connector.

4. Spacer according to claim 1 which is an integral part of the connector.

5. Spacer according to claim 1, wherein the clamping means of the connector comprise a fastening rod and an enlarged passage in one jaw through which the rod passes and i which the rod can tilt when the jaws are clamped up and wherein the spacer in inherently flexible and incorporates a transverse stub adapted to contact one of said jaws and constituting said overridable abutment means which is adapted to be disabled in response to sufficient force applied by the clamping means.

6. Spacer according to claim 5 wherein said stub is adapted to yield by breaking.

7. Spacer according to claim 5 comprising a simple plate.

8. Spacer according to claim 5 wherein said stub is adapted to yield elastically.

9. Spacer according to claim 8 comprising an elastically deformable tang and a housing adapted to receive said tang at least partially and wherein said stub is carried by said tang.

10. Branching electrical connector comprising two jaws, clamping means for clamping said jaws together, at least two parallel channels defined by said jaws, spacer means adapted to hold one of said channels at least partly open temporarily, while the other jaw is swung closed, in response to force applied by the clamping means, said spacer means having overridable abutment means adapted to be disabled in response to sufficient force applied to said jaws by said clamping means to close said one channel.

11. Spacer for use in a branching electrical connector comprising two jaws, clamping means for clamping the jaws together and at least two parallel channels defined by the jaws, the spacer being adapted to hold one of said channels at least partly open temporarily and comprising overridable abutment means adapted to yield by breaking when sufficient force is applied to said jaws by the clamping means to enable the one channel to be closed.

12. Spacer according to claim 11 wherein at least one jaw of said connector comprises a flange and said spacer comprises a plate adapted to lie against said flange on a first side thereof, at least one lug parallel to said plate and a right-angle bend whereby said at least one lug is joined to said plate, said lug being adapted to lie against the opposite side of said flange so that said spacer straddles said flange, and wherein said breakable abutment means are part of said at least one lug.

13. Spacer according to claim 12 wherein at least one lug features a contrasting color marking.

14. Spacer according to claim 12 wherein said breakable abutment means comprise said right-angle bend.

15. Spacer according to claim 14 wherein said right-angle bend in said lug is of reduced thickness to render it readily breakable.

16. Spacer according to claim 15 wherein the thickness of said right-angle bend decreases in the direction from said lug towards said plate.

17. Spacer according to claim 12 wherein each jaw of said connector comprises a respective flange facing towards the flange on the other jaw and said spacer comprises on a first side of said plate at least one lug extending in a first direction and through which it is adapted to cooperate with a first jaw and on the opposite said of said plate at least one other lug extending in the opposite direction and through which it is adapted to cooperate with the other jaw.

18. Spacer according to claim 17 wherein said right-angle bends of said lugs are substantially in alignment.

19. Spacer according to claim 17 wherein said plate comprises one lug on said first side of said plate and two lugs on said other side thereof, said one lug being in a central part of said plate and said two lugs being each on a respective side of said central part.

20. Spacer according to claim 19 wherein said breakable abutment means comprise said right-angle bends in said lugs.

21. Spacer according to claim 20 wherein said right-angle bends in said lugs are of reduced thickness to render them readily breakable.

22. Spacer according to claim 21 wherein the thickness of each right-angle bend decreases in the direction from said lug towards said plate.

23. Spacer for use in a branching electrical connector comprising two jaws, clamping means for clamping the jaws together and at least two parallel channels defined by the jaws, the spacer being adapted to hold one of the channels at least partly open temporarily and comprising overridable abutment means defining an abutment and being elastically disabled in response to the sufficient force applied to jaws by the clamping means to close the one channel.

24. Spacer according to claim 23 wherein the spacer is a part independent of the jaw, and the overridable abutment means comprises an elastically deformable ring adapted to be fitted in an enlarged passage in one of the jaws.

25. Spacer according to claim 23 wherein said overridable abutment means comprise at least one elastically deformable lug and a projecting rib on said at least one elastically deformable lug adapted to be placed on the path of movement of one jaw.

26. Spacer according to claim 25 wherein said at least one elastically deformable lug has a rounded profile and extends cantilever-fashion away from said one jaw with which said rib is adapted to cooperate.

27. Spacer according to claim 25 wherein the other jaw of said connector comprises a flange and said spacer comprises a plate through which it is adapted to lie against a first side of said flange, at least one lug parallel to said plate and a right-angle bend by which said at least one lug is joined to said plate, said at least one lug being adapted to lie against the opposite side of said flange, whereby said spacer straddles said flange, and wherein said at least one elastically deformable lug extends cantilever-fashion from the edge of said plate opposite that adapted to engage said other jaw.

28. Spacer according to claim 23 wherein said clamping means of said connector include a fastening rod, one of said jaws of said connector incorporates an enlarged passage through which said rod passes and in which said rod can tilt when said jaws are clamped up and said overridable abutment means are adapted to be disposed on the path of movement of said rod in said passage.

29. Spacer according to claim 28 wherein said overridable abutment means are adapted to define a throat in said passage.

30. Spacer according to claim 29 comprising two elastically deformable blades in face-to-face relationship, elongate along the path of movement of said rod in said passage and curved towards each other.

31. Spacer according to claim 29 comprising at least one pair of elastically deformable tangs in fact-to-fact relationship, transverse to the path of movement of said rod in said passage and curved towards each other.

32. Spacer according to claim 31 comprising two spaced pairs of elastically deformable tangs.

33. Branching electrical connector comprising two jaws, clamping means for clamping said jaws together, at least two parallel channels defined by said jaws, spacer means adapted to hold one of said channels at least partly open temporarily, while the other jaw is closed in response to force applied by the clamping means, and overridable abutment means on said spacer adapted to be disabled in response to sufficient force applied to said jaws by said clamping means to close said one channel, said abutment means being adapted to be broken in response to said sufficient force.

34. Branching electrical connector comprising two jaws, clamping means for clamping said jaws together, at least two parallel channels defined by said jaws, a spacer adapted to hold one of said channels at least partly open temporarily while the other jaw is closed in response to force applied by the clamping means and overridable abutment means on said spacer adapted to be disabled in response to sufficient force applied to said jaws by said clamping means to close said one channel, said abutment means being adapted to elastically release said spacer in response to said sufficient force.

* * * * *